US007520334B2

(12) United States Patent
Dallas

(10) Patent No.: US 7,520,334 B2
(45) **Date of Patent: *Apr. 21, 2009**

(54) SUBSURFACE LUBRICATOR AND METHOD OF USE

(75) Inventor: L. Murray Dallas, Fairfield, TX (US)

(73) Assignee: Stinger Wellhead Protection, Inc., Oklahoma City, OK (US)

( * ) Notice: Subject to any disclaimer, the term of this patent is extended or adjusted under 35 U.S.C. 154(b) by 184 days.

This patent is subject to a terminal disclaimer.

(21) Appl. No.: 11/540,414

(22) Filed: Sep. 28, 2006

(65) Prior Publication Data

US 2008/0078557 A1 Apr. 3, 2008

(51) Int. Cl.
*E21B 23/08* (2006.01)

(52) U.S. Cl. ..... 166/383; 166/77.4; 166/70

(58) Field of Classification Search ..... 166/77.4, 166/379, 383, 70

See application file for complete search history.

(56) References Cited

U.S. PATENT DOCUMENTS 1,586,923 A * 6/1926 Townsend ..... 166/77.4
1,895,132 A * 1/1933 Minor ..... 166/77.4
2,555,145 A * 5/1951 McKinney ..... 254/29 R
2,755,863 A 7/1956 Stansbury, Jr. et al.
3,071,190 A 1/1963 Ehlert
3,212,581 A * 10/1965 Marshall ..... 166/84.2
3,216,500 A 11/1965 Diehl
3,415,317 A 12/1968 Drivet
3,435,895 A 4/1969 Lee
3,568,767 A 3/1971 Weiss
3,732,928 A 5/1973 Sizer
3,924,686 A 12/1975 Arnold
4,153,111 A * 5/1979 Lans et al. ..... 166/377
4,452,304 A * 6/1984 Barrier et al. ..... 166/70
4,657,075 A * 4/1987 McLeod ..... 166/72
4,681,168 A 7/1987 Kisling, III
4,867,243 A * 9/1989 Garner et al. ..... 166/379
4,993,489 A * 2/1991 McLeod ..... 166/72
4,993,492 A 2/1991 Cressey et al.
5,020,590 A * 6/1991 McLeod ..... 166/77.4
5,025,857 A * 6/1991 McLeod ..... 166/77.4
5,123,356 A 6/1992 Brooks et al.
5,261,487 A 11/1993 McLeod
5,509,481 A 4/1996 Huber et al.
5,529,127 A 6/1996 Burleson et al.
5,568,837 A * 10/1996 Funk ..... 166/383
5,785,121 A 7/1998 Dallas
5,819,851 A 10/1998 Dallas
5,848,646 A 12/1998 Huber et al.

(Continued)

OTHER PUBLICATIONS

U.S. Appl. No. 11/397,838, entitled "Method of Subsurface Lubrication to Facilitate Well Completion, Re-Completion and Workover," filed Apr. 4, 2006.

*Primary Examiner*—Kenneth Thompson
*Assistant Examiner*—Cathleen R Hutchins
(74) *Attorney, Agent, or Firm*—Nelson Mullins Riley & Scarborough, LLP

(57) ABSTRACT

A subsurface lubricator facilitates well completion, re-completion and workover while increasing safety and reducing expense. The subsurface lubricator includes telescopic hydraulic cylinders to lubricate a lubricator tube into the well. For very long tool strings, extension rods and stay rods are used to extend a reach of the telescopic hydraulic cylinders.

20 Claims, 10 Drawing Sheets

U.S. PATENT DOCUMENTS

| | | | | |
|---|---|---|---|---|
| 5,857,523 | A | 1/1999 | Edwards | |
| 5,988,274 | A * | 11/1999 | Funk | 166/77.4 |
| 6,015,014 | A | 1/2000 | McLMeaod et al. | |
| 6,056,055 | A | 5/2000 | Falconer et al. | |
| 6,289,993 | B1 | 9/2001 | Dallas | |
| 6,328,111 | B1 | 12/2001 | Bearden et al. | |
| 6,364,024 | B1 | 4/2002 | Dallas | |
| 6,412,560 | B1 | 7/2002 | Bernat | |
| 6,571,868 | B2 | 6/2003 | Victor | |
| 6,609,571 | B2 | 8/2003 | Nice et al. | |
| 6,626,245 | B1 | 9/2003 | Dallas | |
| 6,712,147 | B2 * | 3/2004 | Dallas | 166/379 |
| 6,755,244 | B1 | 6/2004 | Koopmans | |
| 6,817,421 | B2 | 11/2004 | Dallas | |
| 6,827,147 | B2 * | 12/2004 | Dallas | 166/379 |
| 6,918,441 | B2 | 7/2005 | Dallas | |
| 7,243,733 | B2 | 7/2007 | McGuire et al. | |
| 2003/0221844 | A1 * | 12/2003 | Dallas | 166/381 |
| 2004/0011530 | A1 * | 1/2004 | Felthager, Sr. | 166/377 |
| 2004/0173347 | A1 * | 9/2004 | Dallas | 166/77.1 |
| 2004/0262015 | A1 * | 12/2004 | Mazzella et al. | 166/383 |
| 2005/0217868 | A1 * | 10/2005 | Dallas et al. | 166/387 |
| 2006/0090904 | A1 | 5/2006 | McGuire et al. | |
| 2007/0227744 | A1 * | 10/2007 | Rodgers | 166/380 |

* cited by examiner

SUBSURFACE LUBRICATOR AND METHOD OF USE

FIELD OF THE INVENTION

This invention generally relates to hydrocarbon well completion, recompletion and workover and, in particular, to a subsurface lubricator and a method of using same to facilitate well completion, re-completion and workover.

BACKGROUND OF THE INVENTION

Significant advances in facilitating well completion, re-completion and workover using long downhole tool strings have been described in applicant's published co-pending patent applications US 2007/0227742 A1 and US 2007/0227743, respectively filed on Apr. 4, 2006 and respectively entitled: A Casing Transition Nipple And Method Of Casing A Well To Facilitate Well Completion, Re-Completion And Workover; and Method Of Subsurface Lubrication To Facilitate Well Completion, Re-Completion And Workover; the specifications of which are respectively incorporated herein by reference.

In view of these advances there exists a need for a subsurface lubricator that permits a long tool string to be lubricated into a well cased for subsurface lubrication.

SUMMARY OF THE INVENTION

It is therefore an object of the invention to provide a subsurface lubricator and method of using same to permit a long tool string to be lubricated into a cased wellbore.

The invention therefore provides a subsurface lubricator for lubricating a long tool string into a cased wellbore, comprising: a hollow lubricator tube for housing the long tool string, the lubricator tube having a top end and a bottom end; a lubricator tube adaptor connected to the top end of the lubricator tube, the lubricator tube adaptor having a central passage that communicates with an interior of the hollow lubricator tube, a top flange for connection of equipment for controlling the long tool string, and a radially-oriented injector plate having at least two connection points; an anchor plate having a central passage through which the hollow lubricator tube reciprocates, a packing cavity that surrounds the central passage and accepts high-pressure packing for providing a high pressure fluid seal around an outer periphery of the lubricator tube, and at least two connection points; and a pair of telescopic hydraulic cylinders to lubricate the lubricator tube through a wellhead and into a casing of the cased wellbore, each telescopic hydraulic cylinder being connected one of the connection points on the injector plate and one of the connection points on the anchor plate.

The invention further provides a method of lubricating a downhole tool string into a cased wellbore, comprising: mounting a subsurface lubricator with a hollow lubricator tube that houses the downhole tool string above a pressure control gate mounted above a wellhead of the cased wellbore; and opening the pressure control gate and lubricating the lubricator tube through the wellhead and into a casing of the cased wellbore using telescopic hydraulic cylinders respectively connected to an injector plate affixed to a top end of the lubricator tube and an anchor plate having a central passage through which the lubricator tube can reciprocate.

The invention yet further provides a subsurface lubricator for lubricating a long tool string into a cased wellbore, comprising: a hollow lubricator tube for housing the long tool string, the hollow lubricator tube having a top end and a bottom end; a lubricator tube adaptor connected to the top end of the hollow lubricator tube, the lubricator tube adaptor having a central passage that communicates with an interior of the hollow lubricator tube, a top flange for connection of equipment for controlling the long tool string, and a radially-oriented injector plate having at least four connection points; an anchor plate having a central passage through which the hollow lubricator tube reciprocates, a packing cavity that surrounds the central passage and accepts high-pressure packing for providing a high pressure fluid seal around an outer periphery of the lubricator tube, and at least four connection points; a pair of telescopic hydraulic cylinders to lubricate the lubricator tube through a wellhead and into a casing of the cased wellbore, each telescopic hydraulic cylinder being connected one of the connection points on the anchor plate; at least two extension rods for connecting cylinder rod ends of the telescopic hydraulic cylinders to the connection points on the injector plate; and at least two stay rods for connection between the injector plate and the anchor plate to permit the extension rods to be removed from the cylinder rod ends.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides a subsurface lubricator that facilitates well completion, re-completion and workover. The subsurface lubricator is lubricated down through a wellhead of a well and a production casing supported by the wellhead. The subsurface lubricator permits long tool strings to be lubricated into the well while significantly reducing a distance that an injector for controlling the tool string is located above the ground after the tool string has been lubricated into the well, while providing full-bore access to the cased well. Expense is therefore reduced and safety is improved by lowering working height and reducing mechanical stress on the wellhead, while permitting more downhole operations to be performed in a single run into the cased well.

Figure 1:
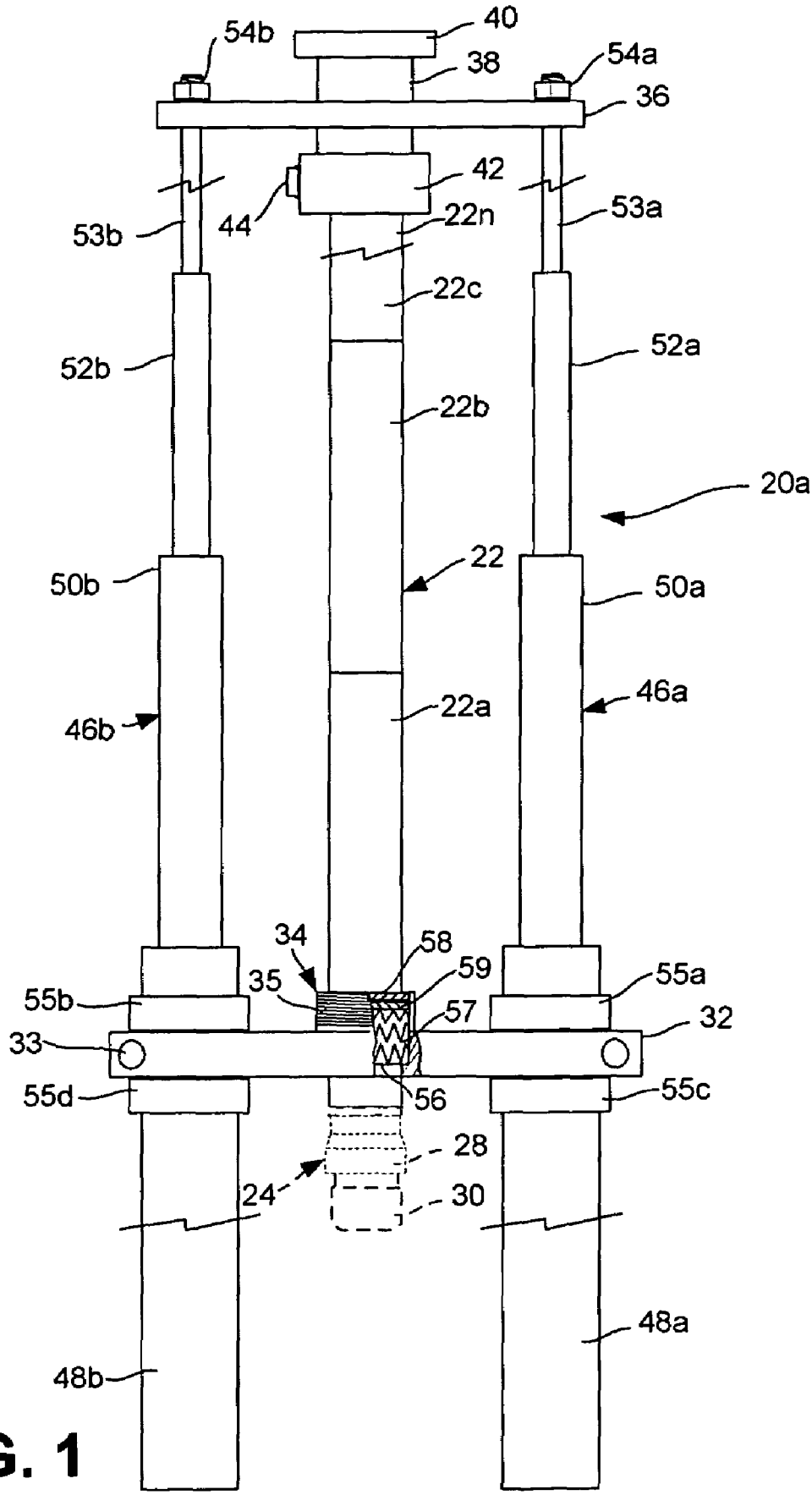
FIG. 1 is a schematic diagram of an embodiment of a subsurface lubricator in accordance with the invention.

FIG. 1 is a schematic diagram, partially in cross-section, showing an embodiment of a subsurface lubricator 20*a* in accordance with the invention. The subsurface lubricator 20*a* includes a lubricator tube 22 made up of a plurality of lubricator joints 22*a*, 22*b*, 22*c*, . . . 22*n*. The number of lubricator joints in the lubricator tube 22 depends on a length of the respective joints (generally 8'-10') and the length of the downhole tool string to be lubricated into a well. The lubricator joints 22*a*-22*n* are threadedly interconnected end-to-end, so that the lubricator tube 22 is a hollow cylinder with smooth cylindrical inner and outer walls. An optional packoff tool 24 is connected to a bottom end of the lubricator tube 22. The optional packoff tool 24 may be any single or double "cup tool", sometimes referred to as a "packoff nipple". For example, any one of the cup tools described in Assignee's U.S. Pat. No. 5,261,487 which issued Nov. 16, 1993; U.S. Pat. No. 6,918,441 which issued Jul. 19, 2005; and published application number 20060090904 which was published on May 4, 2006.

The lubricator tube 22 reciprocates through a central passage in an anchor plate 32. Releasable connectors 33 connect telescopic hydraulic cylinders 46*a*, 46*b* to the anchor plate 32. The telescopic hydraulic cylinders 46*a*, 46*b* respectively include an outer cylinder 48*a*, 48*b*, a plurality of decreasing diameter piston/sleeve assemblies 50*a*, 50*b*, 52*a*, 52*b* concentrically mounted in the outer cylinder 48*a*, 48*b* for reciprocal axial movement relative thereto, and a piston rod 53*a*, 53*b* concentrically mounted within the innermost one of the piston/sleeve assemblies 52*a*, 52*b* for reciprocal axial movement relative thereto. Movement of the outer cylinders 48*a*, 48*b* with respect to the anchor plate 32 is restrained by collars 55*a*-55*d* welded, bolted, clamped, threaded or otherwise affixed to an outer periphery of the respective outer cylinders 48*a*, 48*b*, as will be explained below in more detail with reference to FIG. 3. The function of the telescopic hydraulic cylinders 46*a*, 46*b* will also be described with reference to FIGS. 2-3. Although as shown the telescopic hydraulic cylinders 46*a*, 46*b* have two piston/sleeve assemblies 50*a*, 50*b* and 52*a*, 52*b*, it should be understood that each telescopic hydraulic cylinder 46*a*, 46*b* may include more, or fewer, cylinder/sleeve assemblies as a matter of design choice.

Affixed to the top of the anchor plate 32 is an anchor pin 34. Pin threads 35 are cut into an outer periphery of the anchor pin 34. The pin threads 35 are engaged by box threads of an anchor nut 42 to lock the lubricator tube 22 in the fully lubricated-in position, as will also be explained below with reference to FIG. 3.

Threadedly connected to a top end of the lubricator tube 22 is a lubricator tube adaptor 38. A top end of the lubricator tube adaptor 38 supports an adaptor flange 40. The adaptor flange 40 permits any compatible flanged component to be mounted to a top of the subsurface lubricator 20*a*, such as: a high pressure valve; a blowout preventer (BOP); a frac stack; a coil tubing injector; a wire line grease injector; a coil tubing BOP; a wireline BOP; or any other appropriate equipment. A bottom end of the lubricator tube adaptor 38 includes an annular shoulder (not shown) that rotatably supports the anchor nut 42. The anchor nut 42 may be a spanner nut, or a hammer union having two or more hammer lugs 44, which are well known in the art. The lubricator tube adaptor includes a central passage (not shown) having an internal diameter equal to an internal diameter of the lubricator tube 22.

An injector plate 36 is connected in a radial orientation to the lubricator tube adaptor 38. The injector plate 36 includes at least two connection points for respectively connecting top ends of the telescopic hydraulic cylinder rods 53*a* and 53*b*. The telescopic hydraulic cylinder rods 53*a* and 53*b* are connected to the injector plate 36 by a respective fastener 54*a* and 54*b*, which may be spanner nuts, quick-release connectors, or the like.

The anchor pin 34 and the anchor plate 32 are shown partially in cross-section to illustrate part of an annular packing cavity 56 that surrounds the lubricator tube 22. The annular packing cavity 56 accepts a high-pressure packing 57, such as chevron packing which is well known in the art. The high-pressure packing 57 is retained in the annular packing cavity 56 by packing nut 58. A packing wedge 59, which is a steel ring that is V-shaped in cross-section, compresses the high-pressure packing 57 in the packing cavity 56 when the packing nut 58 is tightened.

Figure 2:
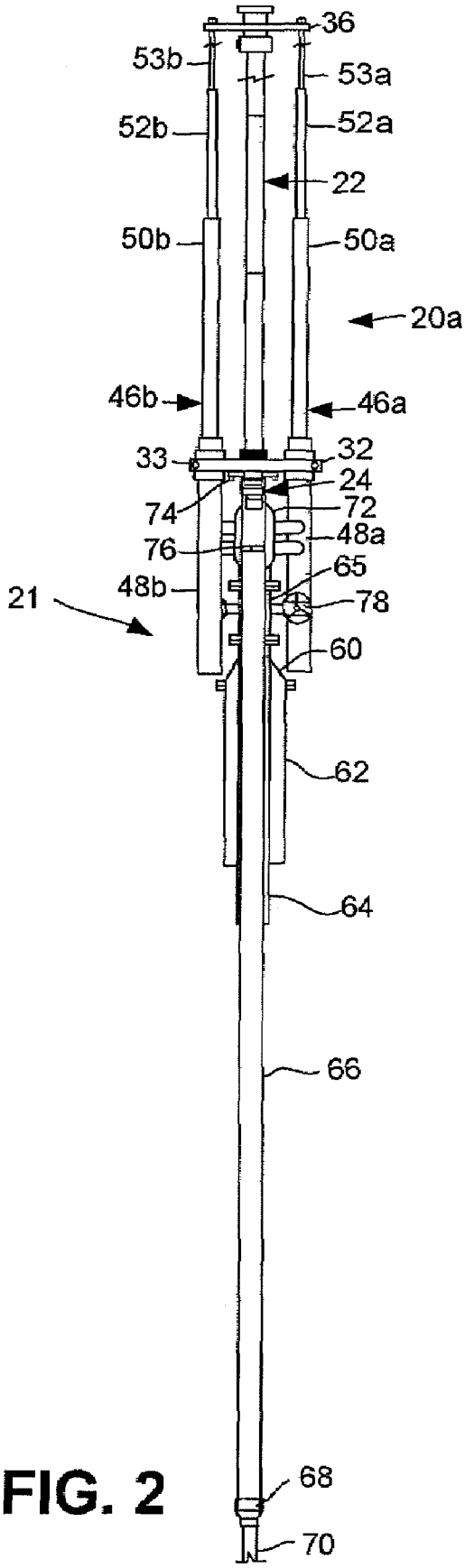
FIG. 2 is a schematic diagram of the subsurface lubricator shown in FIG. 1 mounted to a well cased for subsurface lubrication.

FIG. 2 is a schematic diagram of the subsurface lubricator 20*a* mounted to a wellhead 21 of a well cased as described in applicant's above-referenced U.S. patent application published as US 2007/0227742. The wellhead includes a casing head 60 supported by a conductor 62. The casing head 60 supports a surface casing 64. A tubing head spool 65 is mounted to the casing head 60. The tubing head spool 65 supports a production casing 66 of a first diameter, which extends downwardly to a casing transition nipple 68. The casing transition nipple supports a production casing 70 of a second, smaller diameter. The production casing 70 extends downwardly through the production zone(s) of the well. As will be understood by those skilled in the art, the subsurface lubricator 20*a* and the long tool string that it houses is generally made up on the ground and then hoisted into place using a rig or a crane (not shown). As will also be understood by those skilled in the art, mounted to a top of the subsurface lubricator 20*a* will be at least a coil tubing injector or a wireline grease injector (neither of which is shown) for suspending and manipulating the downhole tool string. Reference may be made to applicant's above-identified co-pending patent applications for a more detailed explanation.

Generally, the subsurface lubricator 20*a* is mounted to a top of a blowout preventer 72 using flange bolts 74 and a metal ring gasket (not shown), which is well known in the art. If the well is a live well, blind rams 76 of the blowout preventer 72 are closed to prevent any escape of hydrocarbons from the well while the subsurface lubricator 20*a* is mounted to the blowout preventer 72.

Figure 3:
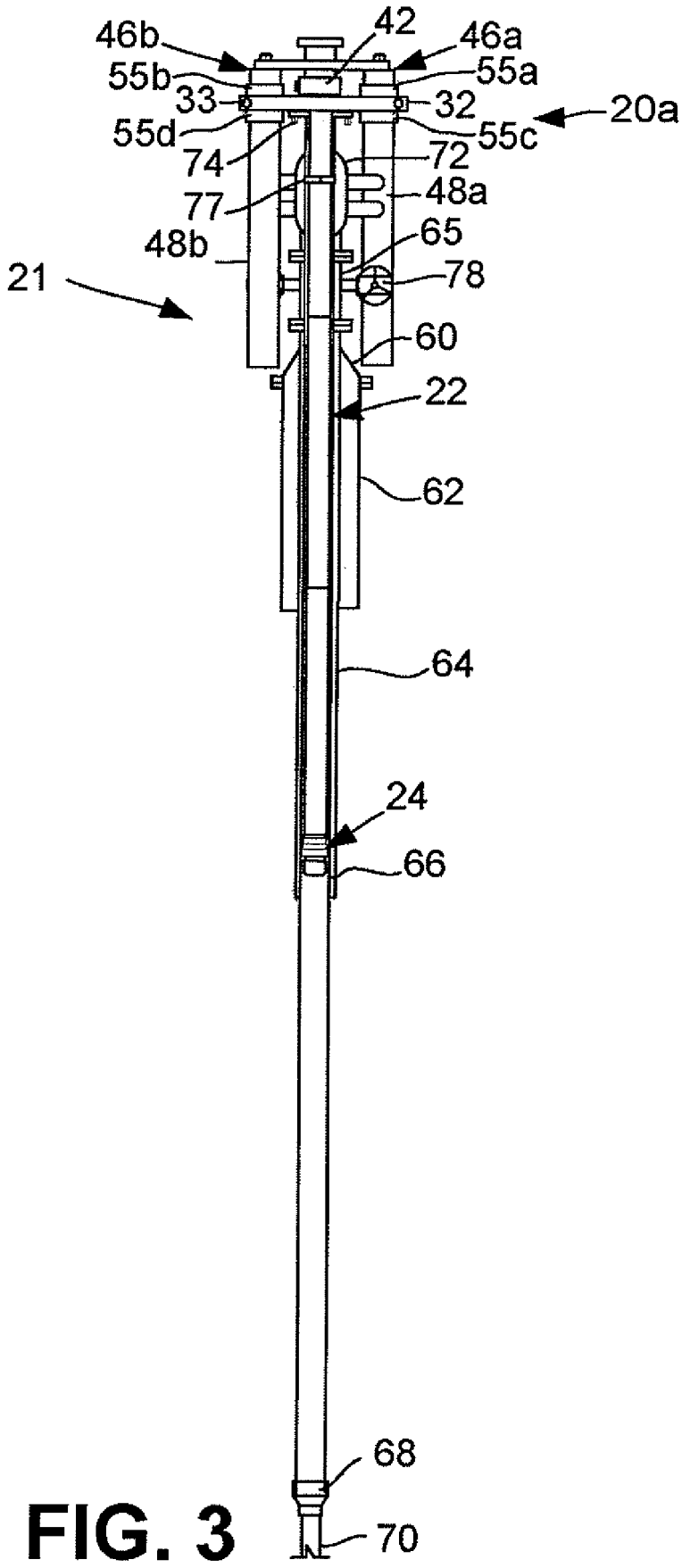
FIG. 3 is a schematic diagram of the subsurface lubricator shown in FIG. 2 after a lubricator tube of the subsurface lubricator has been lubricated into the cased well.

FIG. 3 is a schematic diagram of the subsurface lubricator 20*a* after the lubricator tube 22 has been fully lubricated into the cased well by operating the telescopic hydraulic cylinders 46*a*, 46*b* to draw in the piston/sleeve assemblies 50*a*, 50*b*, 52*a*, 52*b* and the cylinder rods 53*a*, 53*b*. As explained above, relative movement of the telescopic hydraulic cylinders 46*a*, 46*b* is restrained by the collars 55*a*-55*d* affixed to the outer cylinders 48*a* and 48*b*. The collars 55*a* and 55*b* respectively support the respective telescopic hydraulic cylinders 46*a* and 46*b* on the anchor plate, and the collars 58*c* and 58*d* respectively inhibit upward movement of the respective telescopic hydraulic cylinders 46*a* and 46*b*. Thus any axial movement of the outer cylinder 48*a* and 48*b* with respect to the anchor plate 32 is inhibited. The telescopic hydraulic cylinders 46*a* and 46*b* can therefore control the lubricator tube 22 regardless of whether the well contains natural pressure or not.

After the lubricator tube 22 has been fully lubricated into the cased well, as shown in FIG. 3, the anchor nut 42 is threaded onto the anchor sleeve 34 (FIG. 1) to lock the lubricator tube 22 in the fully lubricated-in position. This ensures that the lubricator tube 22 cannot be ejected from the well during downhole operations, even if hydraulic fluid pressure on the telescopic hydraulic cylinders is released for any reason.

If the bottom end of the lubricator tube 22 is equipped with the optional cup tool 24, the wellhead 21 is isolated from any high pressure fluids injected into the well during downhole operations performed using the elongated tool string (not shown) housed in the lubricator tube 22.

Figure 4:
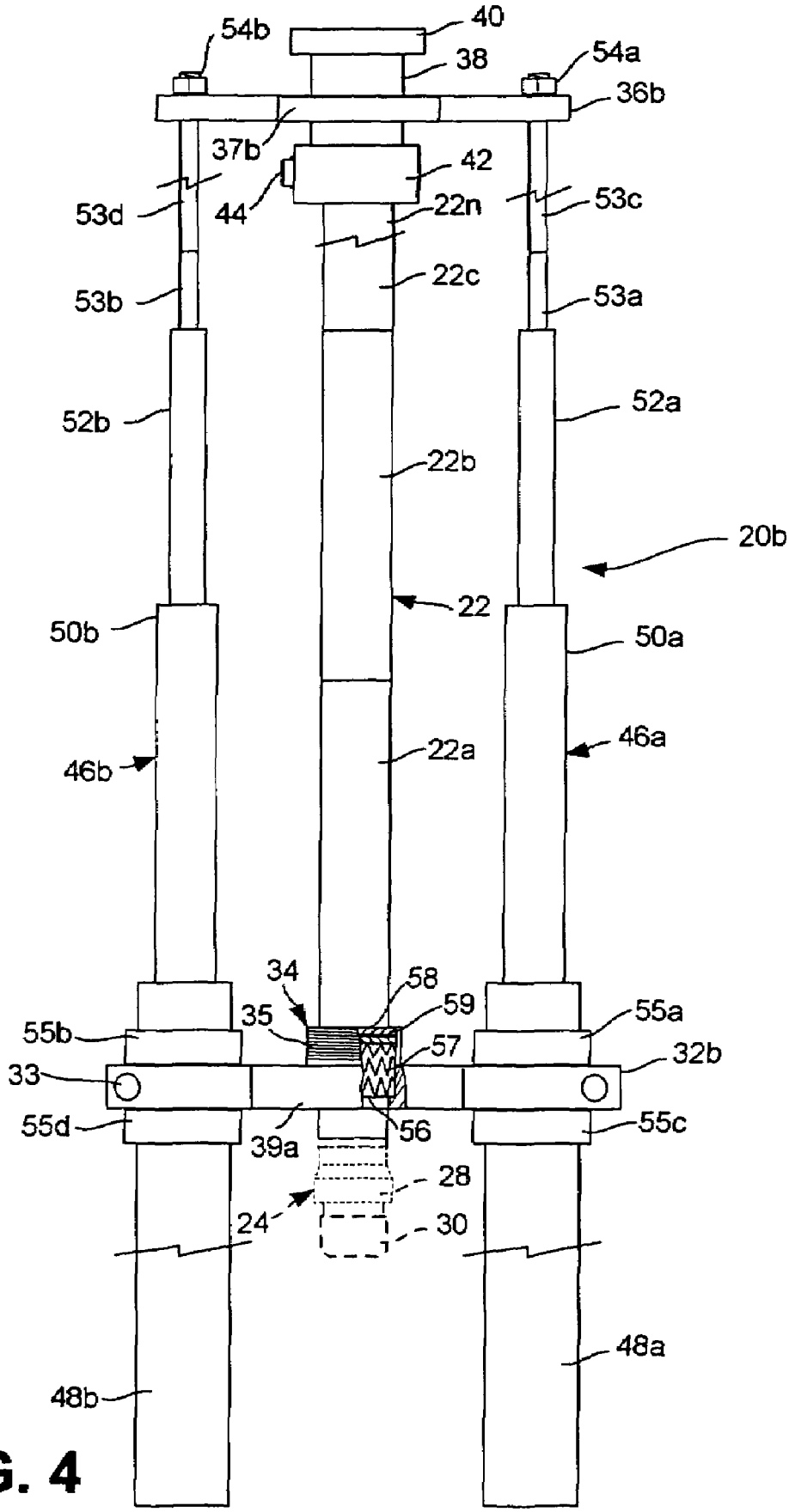
FIG. 4 is a schematic diagram of another embodiment of a subsurface lubricator in accordance with the invention.

FIG. 4 is a schematic diagram of another embodiment of a subsurface lubricator 20*b* in accordance with the invention. The subsurface lubricator 20*b* is identical to the subsurface lubricator 20*a* described above, with two exceptions that permit the subsurface lubricator 20*b* to be used to lubricate even longer tool strings into the cased well. First, the subsurface lubricator 20*b* includes connection points 37*a* and 37*b* (FIG. 5) on injector plate 36*b* and connection points 39*a* and 39*b* (FIG. 6) on anchor plate 32*b*. The respective connection points permit the connection of stay rods, the function of which will be explained below with reference to FIGS. 7-11. Second, top ends of the cylinder rods 53*a* are 53*b* are configured for the connection of extension rods 53*c* and 53*d*, as well as for the connection of respective fasteners 54*a* and 54*b*, which may be spanner nuts, quick-release connectors, or the like. In all other respects the subsurface lubricators 20*a* and 20*b* are identical and the other parts of the subsurface lubricator 20*b* will not be redundantly described.

Figure 5:
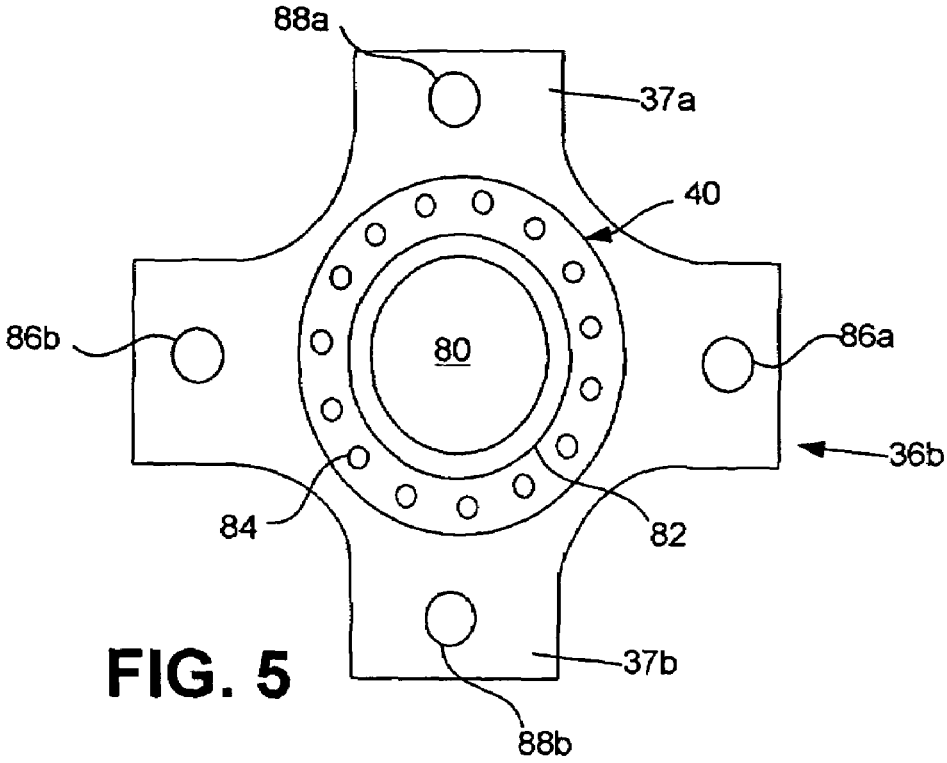
FIG. 5 is a schematic diagram of a top plan view of an injector plate of the subsurface lubricator shown in FIG. 4.

FIG. 5 is a top plan view of one embodiment of the injector plate 36*b* shown in FIG. 4. As explained above, the lubricator tube adaptor 38 has the top flange 40 which surrounds a central passage 80. The top flange 40 includes a metal ring gasket groove 82 and a plurality of axial bores 84 that accept flange bolts or studs (not shown) to connect equipment to a top of the subsurface lubricator 20*b*. As described above, the injector plate 36*b* includes connection points 37*a* and 37*b*, which in this embodiment are bores 88*a* and 88*b* through forward and rearward extensions 37*a* and 37*b* of the injector plate 36*a*. The bores 88*a* and 88*b* receive respective ends of the stay rods, as will be explained below in more detail.

Figure 6:
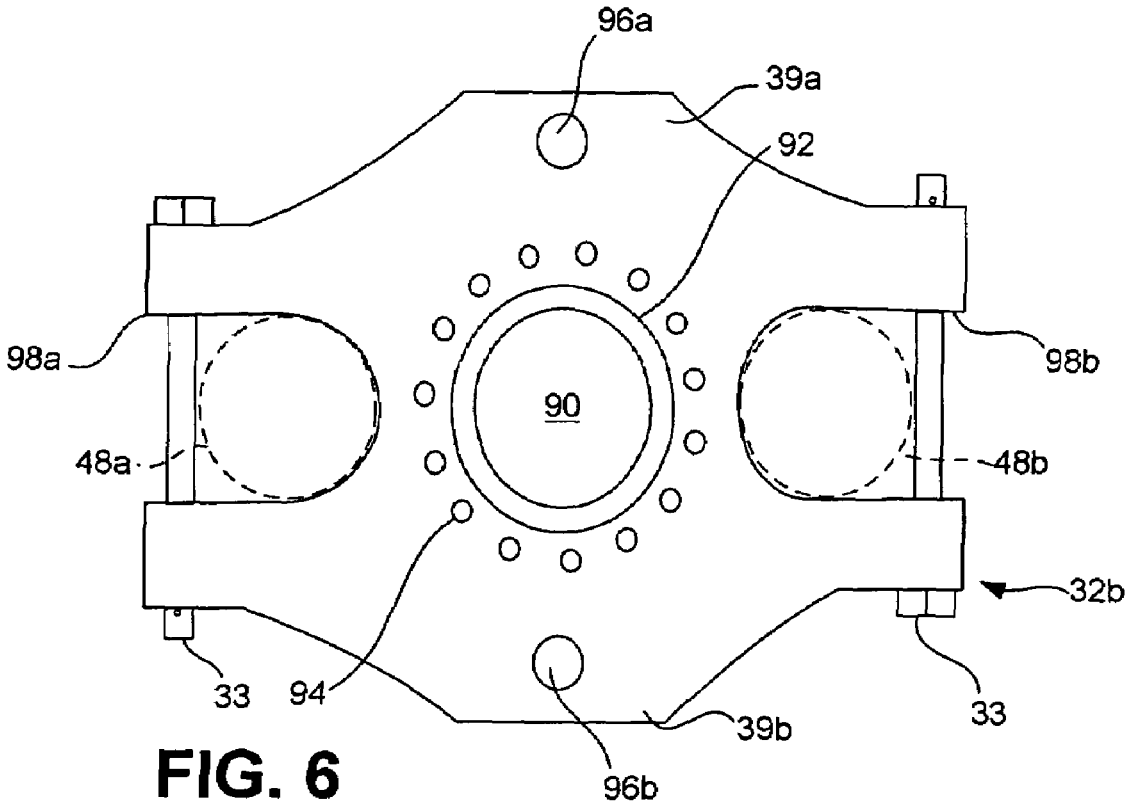
FIG. 6 is a schematic diagram of a bottom plan view of an anchor plate of the subsurface lubricator shown in FIG. 4.

FIG. 6 is a bottom plan view of the anchor plate 32*b* shown in FIG. 4. The anchor plate 32*b* has a central passage 90 through which the lubricator tube 22 reciprocates. The central passage 90 is surrounded by a ring gasket groove 92 and a plurality of bores 94 for receiving flange bolts or studs for connecting the reciprocating lubricator 20*b* to flow control equipment, such as the blowout preventer 72. As described above, the anchor plate 32*b* includes connection points, which in this embodiment are bores 96*a* and 96*b* through forward and rearward extensions 39*a* and 39*b* of the anchor plate 32*b*. The bores 96*a* and 96*b* receive respective ends of stay rods, as will also be explained below in more detail. The anchor plates 32 and 32*b* also include U-shaped slots 98*a* and 98*b* which receive the outer cylinders 48*a* and 48*b* of the telescopic hydraulic cylinders 46*a* and 46*b*. The quick-release connectors 33 retain the outer cylinders 48*a* and 48*b* in the respective U-shaped slots 98*a* and 98*b*. When the outer cylinders 48*a* and 48*b* are placed in the U-shaped slots 98*a* and 98*b*, the collars 55*a* and 55*b* respectively slide over a top of the anchor plates 32 and 32*b*, and the collars 55*c* and 55*d* slide under the anchor plates 32 and 32*b* to inhibit axial movement of the outer cylinders 48*a* and 48*b*, as described above.

Figure 7:
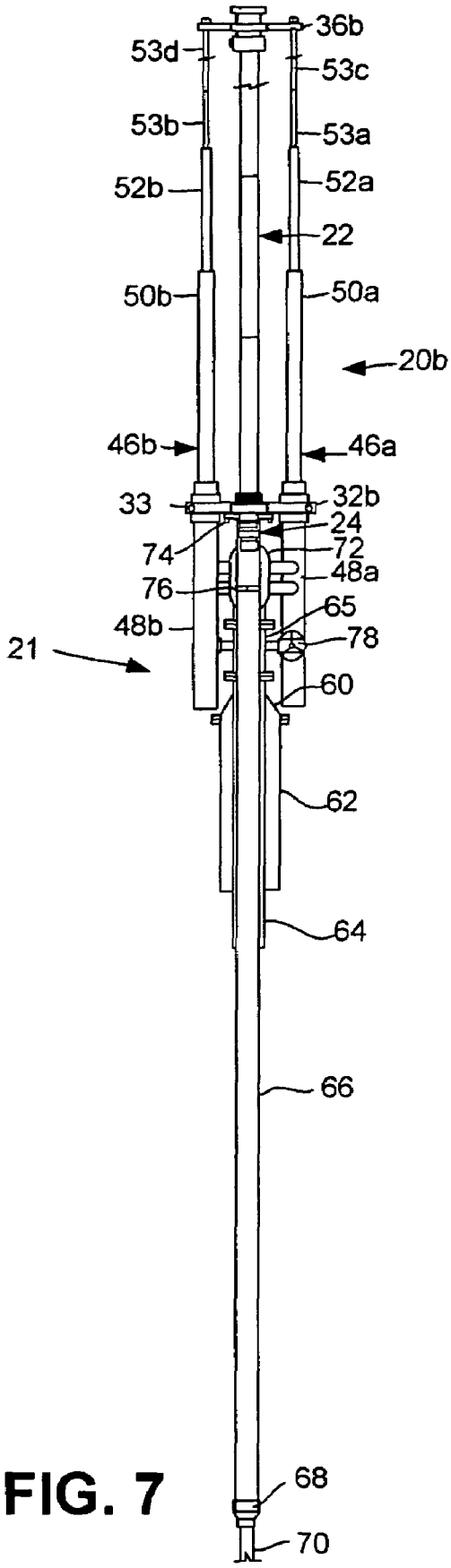
FIG. 7 is a schematic diagram of the subsurface lubricator shown in FIG. 4 mounted to a well cased for subsurface lubrication.
Figure 8:
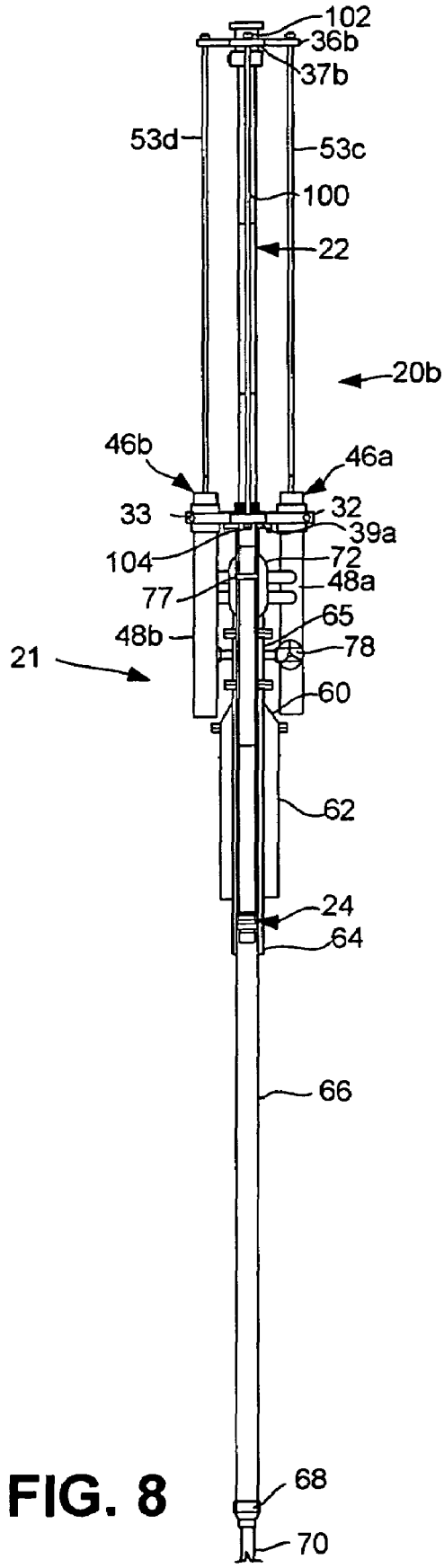
FIG. 8 is a schematic diagram of the subsurface lubricator shown in FIG. 4 in a partially lubricated-in position, with telescopic cylinders completely drawn in and stay rods attached.

FIG. 7 is a schematic diagram of the subsurface lubricator 20*b* shown in FIG. 4 mounted to the wellhead 21. This is a first stage in a process of lubricating the lubricator tube 22 into the cased well after the subsurface lubricator 20*b* has been assembled and hoisted onto the wellhead 21. Once the subsurface lubricator 20*b* has been mounted to the BOP 72 using the flange bolts 74, the blind rams 76 of the BOP 72 are opened after appropriate pressure balancing, and the telescopic hydraulic cylinders 46*a*, 46*b* are operated to draw in the piston/sleeve assemblies 50*a* and 50*b*, 52*a* and 52*b*, and cylinder rods 53*a* and 53*b*. This lubricates the lubricator tube partially into the well so that the optional packoff tool 24 passes through the BOP 72, the tubing head spool 65 and into the casing 66, as shown in FIG. 8. If the BOP 72 is equipped with appropriately sized tubing rams, the tubing rams 77 may then be closed to provide another fluid seal around the lubricator tube 22.

FIG. 8 is a schematic diagram illustrating a second stage in the process of lubricating the lubricator tube 22 into the cased well. After the lubricator tube 22 has been partially lubricated into the well using the telescopic hydraulic cylinders 46*a*, 46*b*. Stay rods 100 are connected to the connection points 37*a* and 37*b* on the injector plate 36*b* and the connection points 39*a* and 39*b* on the anchor plate 32*b*. A length of the stay rods 100 is selected to permit the extension rods 53*c* and 53*d* to be removed. While it is convenient that a length of the stay rods 100 is less than the full stroke length of the telescopic hydraulic cylinders 46*a*, 46*b*, this is not required. The lubricator tube 22 can be lubricated into the casing 66 in any number of stages using different sets of extension rods 53*c*, 53*d* and stay rods 100 of a respective length required to accomplish a multi-stage lubrication procedure.

After the extension rods 100 are inserted through bores 88*a* and 88*b* in the injector plate 36*b* and bores 96*a*, 96*b* in the anchor plate 32*b*, they are locked in place using fasteners 102, 104, which may be spanner nuts or quick-release connectors. The hydraulic cylinders are then operated to transfer the load to the stay rods 100 and the extension rods 53*c* and 53*d* are removed.

Figure 9:
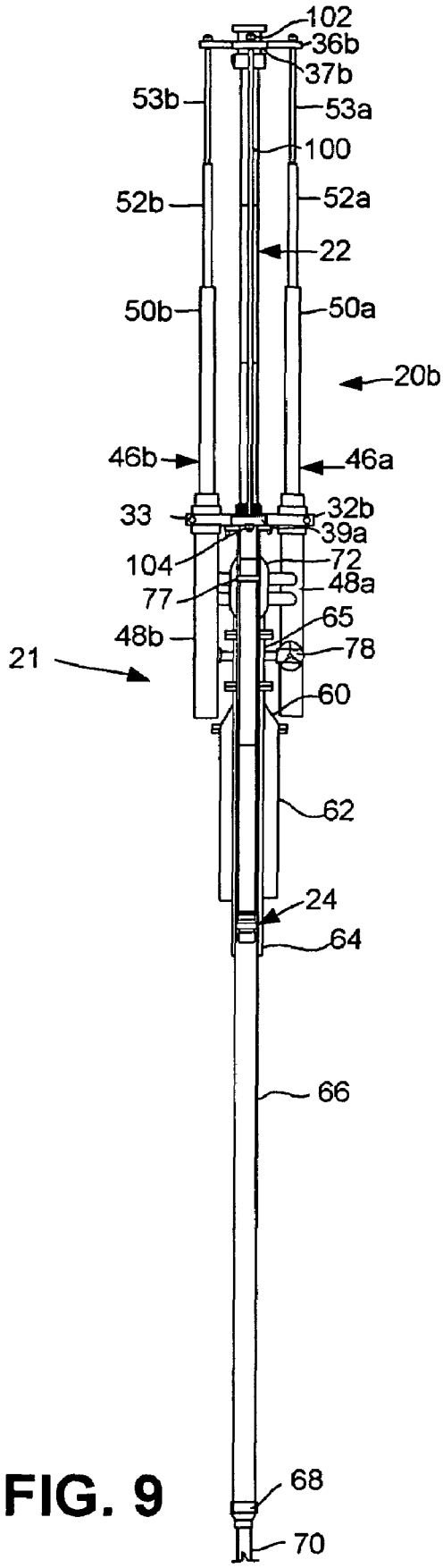
FIG. 9 is a schematic diagram of the subsurface lubricator shown in FIG. 8 with the telescopic cylinders extended and reconnected while the stay rods hold to a lubricator tube of the subsurface lubricator in the partially lubricated-in position.
Figure 10:
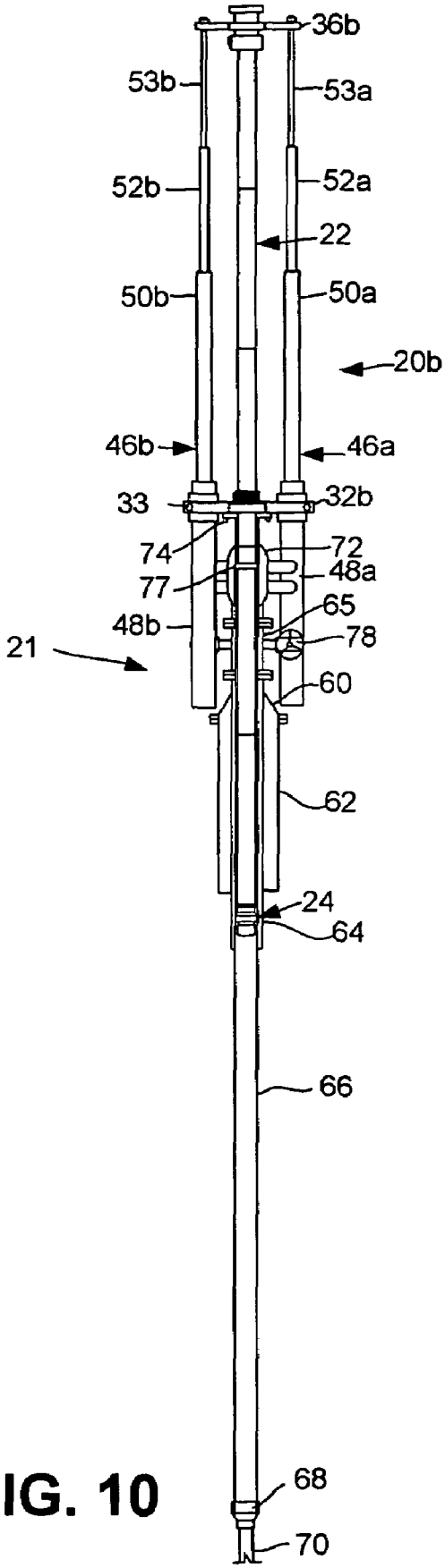
FIG. 10 is a schematic diagram of the subsurface lubricator shown in FIG. 9 with the stay rods removed.
Figure 11:
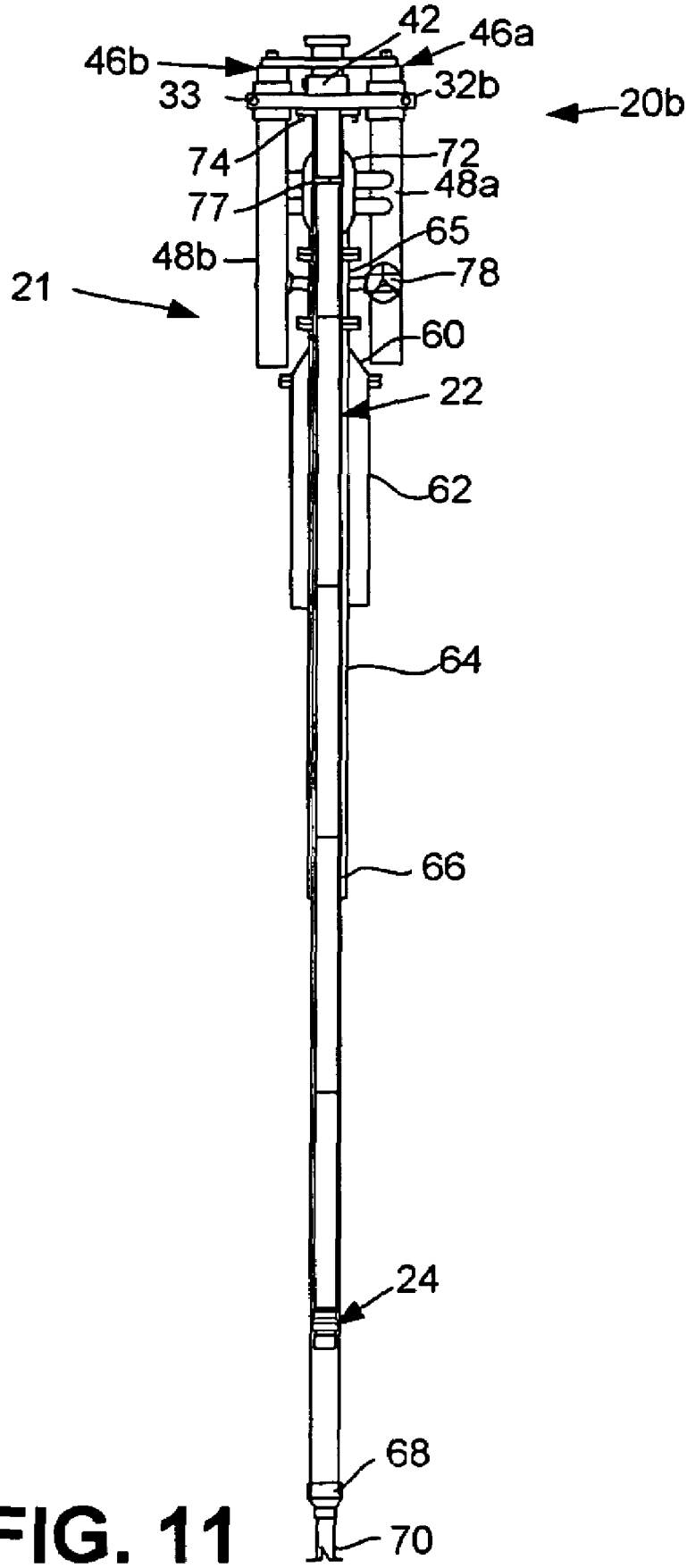
FIG. 11 is a schematic diagram of the subsurface lubricator shown in FIG. 10 in a fully lubricated-in position.

As shown in FIG. 9, after the extension rods 53*a*, 53*b* have been removed, the telescopic hydraulic cylinders 46*a* and 46*b* are extended and connected to the injector plate 36*b*, assuming only two stages are used to lubricate the lubricator tube 22 into the wellbore. The stay rods 100 are then removed, as shown in FIG. 10. The telescopic cylinders are thereafter operated to fully lubricate in the lubricator tube 22, as shown in FIG. 11, and the anchor nut 42 is used to lock the lubricator tube 22 in the fully lubricated-in position. The downhole tool string housed in the lubricator tube 22 can then be lowered into the cased well and manipulated to perform any of the functions for which it was designed.

Since the internal diameter of the lubricator tube 22 is at least as large as an internal diameter of the production casing 70, the subsurface lubricator 20 provides full-bore access to the cased wellbore. Well stimulation fluids can also be pumped down a coil tubing string (not shown) supporting the downhole tubing string, or "down the backside" through the lubricator tube 22. As will be explained below with reference to FIGS. 10 and 11, the optional packoff tool 24 completely isolates the wellhead from high-pressure well stimulation fluids.

After the downhole tool string has been used as planned, it is pulled back up into the lubricator tube by operating the coil tubing injector or the wireline injector (neither of which is shown), and the lubricator tube 22 is lubricated out of the cased well by reversing the procedures described above.

Although the subsurface lubricators 20*a* and 20*b* have been described with reference to a pair of telescopic hydraulic cylinders, it should be understood that three or more telescopic hydraulic cylinders and three or more stay rods can be used for the same purpose. All references to "a pair" are therefore intended to mean two or more.

The embodiments of the invention described above are therefore intended to be exemplary only, and the scope of the invention is intended to be limited solely by the scope of the appended claims.

I claim:

1. A subsurface lubricator for lubricating a long tool string into a cased wellbore, comprising:

a hollow lubricator tube for housing the long tool string, the lubricator tube having a top end and a bottom end;

a lubricator tube adaptor connected to the top end of the lubricator tube, the lubricator tube adaptor having a central passage that communicates with an interior of the hollow lubricator tube, a top flange for connection of equipment for controlling the long tool string, and a radially-oriented injector plate having at least four connection points;

an anchor plate having a central passage through which the hollow lubricator tube reciprocates, a packing cavity that surrounds the central passage and accepts high-pressure packing for providing a high pressure fluid seal around an outer periphery of the lubricator tube, and at least four connection points;

a pair of telescopic hydraulic cylinders to lubricate the lubricator tube through a wellhead and into a casing of the cased wellbore, each telescopic hydraulic cylinder being connected to one of the connection points on the injector plate and one of the connection points on the anchor plate;

extension rods for connecting cylinder rod ends of the telescopic hydraulic cylinders to the connection points of the injector plate;

stay rods having first and second ends for respective connection to a one of the connection points on the injector plate and a one of the connection points on the anchor plate, the stay rods used to secure the lubricator tube in a partially lubricated-in position while the telescopic hydraulic cylinders are being extended for reconnection to the injector plate; and a packoff tool connected to the bottom end of the lubricator tube provide a high pressure seal to isolate a wellhead of the cased wellbore from fluid pressure in the lubricator tube and the cased well bore below the packoff tool.

2. The subsurface lubricator as claimed in claim 1 wherein the anchor plate further comprises an anchor pin surrounding the central passage, the anchor pin including a pin thread on an outer periphery thereof.

3. The subsurface lubricator as claimed in claim 2 wherein the lubricator tube adaptor further comprises a radial shoulder on a bottom end thereof, the radial shoulder rotatably supporting an anchor nut having a box thread that engages the pin thread on the anchor pin to lock the lubricator tube in the cased wellbore after the lubricator tube has been fully lubricated into the cased wellbore.

4. The subsurface lubricator as claimed in claim 1 wherein the packoff comprises a cup tool.

5. The subsurface lubricator as claimed in claim 4 wherein the cup tool comprises a cup tool mandrel supporting a downwardly oriented elastomeric cup for providing the high pressure fluid seal.

6. The subsurface lubricator as claimed in claim 1 comprising two extension rods that respectively connect cylinder rod ends of the telescopic hydraulic cylinders to two of the connection points on the injector plate.

7. The subsurface lubricator as claimed in claim 6 comprising two stay rods to secure the lubricator tube in a partially lubricated-in position while the telescopic hydraulic cylinders are being extended for reconnection to the injector plate.

8. A method of lubricating a downhole tool string into a cased wellbore, comprising:

mounting a subsurface lubricator with a hollow lubricator tube that houses the downhole tool string above a pressure control gate mounted above a wellhead of the cased wellbore;

opening the pressure control gate and lubricating the lubricator tube through the wellhead and into a casing of the cased wellbore using telescopic hydraulic cylinders with extension rods connected to cylinder rod ends of the telescopic hydraulic cylinders and respectively connected to two of at least four connection points of an injector plate affixed to a top end of the lubricator tube, the telescopic hydraulic cylinders being connected to two of at least four connection points of an anchor plate having a central passage through which the lubricator tube can reciprocate;

operating the telescopic hydraulic cylinders to draw in piston/sleeve assemblies and the cylinder rods of the telescopic hydraulic cylinders; and connecting stay rods to the injector plate and the anchor plate so that the extension rods can be disconnected from the injector plate and removed from the cylinder rod ends.

9. The method as claimed in claim 8 further comprising:

re-extending the piston/sleeve assemblies and the cylinder rods of the telescopic hydraulic cylinders;

reconnecting the cylinder rod ends to respective connection points of the injector plate;

removing the stay rods; and operating the telescopic hydraulic cylinders to draw in piston/sleeve assemblies and the cylinder rods of the telescopic hydraulic cylinders to further lubricate the lubricator tube into the cased wellbore.

10. The method as claimed in claim 9 further comprising lubricating the lubricator tube out of the wellhead after using the downhole tool string to perform downhole operations.

11. The method as claimed in claim 10 wherein lubricating the lubricator tube out of the wellhead comprises operating the telescopic hydraulic cylinders to extend the piston/sleeve assemblies and the cylinder rods of the telescopic hydraulic cylinders, and connecting the stay rods between the two of the at least four connection points of the injector plate and the anchor plate.

12. The method as claimed in claim 11 further comprising:

disconnecting the cylinder rod ends of the telescopic hydraulic cylinders from the injector plate;

operating the telescopic hydraulic cylinders to draw in the piston/sleeve assemblies and the cylinder rods;

connecting extension rods between the cylinder rod ends and the injector plate;

operating the telescopic hydraulic cylinders to release the stay rods;

operating the telescopic hydraulic cylinders to extend the piston/sleeve assemblies and the cylinder rods to fully lubricate the lubricator tube out of the cased wellbore; and removing the subsurface lubricator from the wellhead.

13. A subsurface lubricator for lubricating a long tool string into a cased wellbore, comprising:

a hollow lubricator tube for housing the long tool string, the hollow lubricator tube having a top end and a bottom end;

a lubricator tube adaptor connected to the top end of the hollow lubricator tube, the lubricator tube adaptor having a central passage that communicates with an interior of the hollow lubricator tube, a top flange for connection of equipment for controlling the long tool string, and a radially-oriented injector plate having at least four connection points;

an anchor plate having a central passage through which the hollow lubricator tube reciprocates, a packing cavity that surrounds the central passage and accepts high-pressure packing for providing a high pressure fluid seal around an outer periphery of the lubricator tube, and at least four connection points;

a pair of telescopic hydraulic cylinders to lubricate the lubricator tube through a wellhead and into a casing of the cased wellbore, each telescopic hydraulic cylinder being connected one of the connection points on the anchor plate;

at least two extension rods for connecting cylinder rod ends of the telescopic hydraulic cylinders to the connection points on the injector plate; and at least two stay rods for connection between the injector plate and the anchor plate to permit the extension rods to be removed from the cylinder rod ends.

14. The subsurface lubricator as claimed in claim 13 wherein at least two of the connection points on the anchor plate comprise U-shaped slots, each U-shaped slot slidably receiving an outer cylinder of a one of the telescopic hydraulic cylinders.

15. The subsurface lubricator as claimed in claim 14 wherein each telescopic hydraulic cylinder further comprises first and second spaced apart collars affixed to a periphery of the outer cylinder, a one of the collars sliding over a top of the anchor plate and the other of the collars sliding under the anchor plate when the outer cylinder is slid into the U-shaped slot, to inhibit axial movement of the outer cylinder with respect to the anchor plate.

16. The subsurface lubricator as claimed in claim 13 wherein the lubricator tube adaptor further comprises an annular shoulder for rotatably supporting an anchor nut for locking the lubricator tube to the anchor plate.

17. The subsurface lubricator as claimed in claim 13 further comprising a packoff tool connected to the bottom end of the lubricator tube, that provides a high pressure fluid seal to isolate the wellhead from fluid pressure in the lubricator turbo and the cased wellbore below the packoff tool.

18. The subsurface lubricator as claimed in claim 17 wherein the packoff tool comprises a cup tool.

19. The subsurface lubricator as claimed in claim 18 wherein the cup tool comprises a cup tool mandrel supporting a downwardly oriented elastomeric cup for providing the high pressure fluid seal.

20. The subsurface lubricator as claimed in claim 13 wherein the lubricator tube comprises a plurality of lubricator joints connected end-to-end to provide an elongated lubricator tube having smooth cylindrical inner and outer surfaces.

* * * * *

UNITED STATES PATENT AND TRADEMARK OFFICE

CERTIFICATE OF CORRECTION

PATENT NO. : 7,520,334 B2
APPLICATION NO. : 11/540414
DATED : April 21, 2009
INVENTOR(S) : L. Murray Dallas It is certified that error appears in the above-identified patent and that said Letters Patent is hereby corrected as shown below:

In the Claims:
Please correct, in the claims, column 10, line 16, please delete “turbo” and replace with --tube--.

Signed and Sealed this

Second Day of June, 2009

JOHN DOLL
*Acting Director of the United States Patent and Trademark Office*